US009222227B2

(12) United States Patent
Kopacz et al.

(10) Patent No.: US 9,222,227 B2
(45) Date of Patent: Dec. 29, 2015

(54) EXTENDABLE SCREED HEIGHT ADJUSTING SYSTEM WITH ANGLE OF ATTACK ADJUSTMENT

(71) Applicant: Caterpillar Paving Products Inc., Brooklyn Park, MN (US)

(72) Inventors: Jason Kopacz, St. Louis Park, MN (US); Jameson Smieja, Mound, MN (US); Chad M. Arnold, Peoria, IL (US); Tim Wehrenberg, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 26 days.

(21) Appl. No.: 14/173,276

(22) Filed: Feb. 5, 2014

(65) Prior Publication Data

US 2015/0218761 A1 Aug. 6, 2015

(51) Int. Cl.

| | |
|---|---|
| ***E01C 19/42*** | (2006.01) |
| ***E01C 19/22*** | (2006.01) |
| ***E01C 19/44*** | (2006.01) |

(52) U.S. Cl.

CPC ..... *E01C 19/42* (2013.01); *E01C 19/22* (2013.01); *E01C 19/44* (2013.01)

(58) Field of Classification Search

CPC ..... E01C 19/22; E01C 19/42; E01C 19/44
USPC ..... 404/118, 96, 101, 105
See application file for complete search history.

(56) References Cited

U.S. PATENT DOCUMENTS

| | | | | |
|---|---|---|---|---|
| 6,158,921 | A | 12/2000 | Holmes | |
| 6,174,105 | B1 | 1/2001 | Holmes et al. | |
| 2010/0150651 | A1* | 6/2010 | Buschmann et al. | 404/82 |

* cited by examiner

*Primary Examiner* — Raymond W Addie
(74) *Attorney, Agent, or Firm* — Miller, Matthias & Hull LLP

(57) ABSTRACT

An extendable screed has independent height and angle of attack adjustment for a lower extender frame. At least one post and cylinder assembly are used to couple the lower extender frame to an upper extender frame at a pin that allows rotation of the lower extender frame relative to the upper extender frame. A vertical adjuster uses a drive rod with a pivoting attachment at the lower extender frame. An axis of rotation of the pin and an axis of rotation of the pivoting attachment are co-linear. This arrangement allows lower extender frame to move vertically while allowing angle of attack adjustments to be made about the co-linear axes of rotation. Simple screw adjusters displaced from the axis of the pin and collet assemblies allow raising and lowering the back of the lower extender frame to adjust the angle of attack.

20 Claims, 4 Drawing Sheets

EXTENDABLE SCREED HEIGHT ADJUSTING SYSTEM WITH ANGLE OF ATTACK ADJUSTMENT

TECHNICAL FIELD

The present disclosure relates paving systems and more particularly to a height and angle of attack adjusting system for a screed extension.

BACKGROUND

Paving systems use screeds to heat and compress paving materials, particularly asphalt paving materials. A screed of a paver may be adjustable out to six meters, but often it is desirable to extend the width through the use of extendable screeds. These extensions may add an additional 2 meters on either side of the main screed, for example, using hydraulically adjustable extendable screeds.

The extendable screeds may be mounted to the main screed body, but for various reasons are not usually collinear with the main screed body. For example, the extendable screeds may be mounted behind the main screed. Therefore, when the height of the main screed body is adjusted up or down, or its angle of attack is changed, the extension may move differently than the main body because it has a different radius from a pivot point of the main screed body. Angle of attack is the front-to-back angle of a screed that affects the difference in height above the paving surface of the front of the screed vs. the back of the screed.

Many current systems use a 'four post' system for adjusting the height and angle of attack of an extendable screed. However, manually loosening each post, making the adjustment, and re-tightening each post is very time and labor intensive. Other systems may allow the trailing edge of the extendable screed to be manually adjusted, but like the four post system, six or more individual bolts with locking nuts may need to be adjusted to make a change. Both of these adjustment techniques are time consuming and, given the work environment, often hot, dirty, and difficult to work on.

U.S. Pat. No. 6,158,921 discloses a screed extension mounted in front of a main screed body so that a rear-facing side of the extension touches a front-facing side of the main screed body. The distance of the extension from the main body determines where the contact between the two occurs and therefore, the angle of attack of the extendable screed. While the '921 patent discloses both height adjustment and angle of attack adjustment, the angle of attack is directly a function of its height and requires fore-and-aft adjustment for each change in height. The '921 patent does not disclose an extendable screed adjustment system that allows independent height and angle of attack adjustment.

SUMMARY

According to one aspect of the disclosure, an adjustment apparatus for adjusting an extendable screed relative to a main screed includes an upper extender frame coupled to one or more extend tubes of the main screed, a height tube coupled to the upper extender frame and a post movably inserted in the height tube. The adjustment apparatus may further include a first bracket attached to a lower portion of the post. The first bracket may be welded or otherwise attached to the post. The first bracket may include an ear attached to the bottom of the first bracket, for example, the ear may be welded to the bottom of the first bracket. The adjustment apparatus may also include a lower extender frame having a bulkhead plate that is proximate to the ear. A pin disposed through the ear and the bulkhead plate couples the post to the lower extender frame and allows rotation of the lower extender frame about a longitudinal axis of the pin.

According to another aspect of the disclosure, a method of adjusting an extendable screed, having upper and lower extender frames, relative to a main screed includes vertically supporting the lower extender frame of the extendable screed with a drive rod. The drive rod may be used to raise and lower the lower extender frame. The drive rod may be coupled at a first rotatable coupling that attaches the lower extender frame to the drive rod. The method may also include laterally supporting the lower extender frame with a post rotatably coupled to the lower extender frame at a second rotatable coupling. The post may be disposed in a tube coupled to the upper extender frame. The drive rod may be configured to operate such that rotating or turning the drive rod may cause the lower extender frame to raise or lower vertically. The method may include configuring the lower extender frame to rotate the lower extender frame about the first and second rotatable couplings to change an angle of attack of the lower extender frame relative to the main screed.

In yet another aspect of the disclosure, an apparatus is discussed and described for adjusting a height and angle of attack of an extendable screed relative to a main screed in a paving machine. The apparatus includes an upper extender frame coupled to one or more extend tubes of the main screed, a height tube coupled to the upper extender frame, a post movably inserted in the height tube and a first bracket attached to a lower portion of the post. The first bracket may include an ear. The apparatus may include a lower extender frame having a bulkhead plate proximate to the ear and a pin disposed through the ear and the bulkhead plate. The pin may couple the post and first bracket to the lower extender frame to allow rotation of the lower extender frame about a longitudinal axis of the pin. At least one elongate member may be coupled between the first bracket and the lower extender frame and may be displaced from the longitudinal axis of the pin. The at least one elongate member may be configured to extend and retract to set an angle of attack via rotation of the lower extender frame with respect to the upper extender frame about the longitudinal axis of the pin. The apparatus may also include a vertical adjuster that may in itself include a drive rod, a bearing housing trunnion mount coupled to the upper extender frame and configured turn the drive rod, and a trunnion block-lift attached to the drive rod and the lower extender frame configured to be raised and lowered relative to the bearing housing trunnion mount by turning the drive rod.

These and other benefits will become apparent from the specification, the drawings and the claims.

DESCRIPTION

Figure 1:
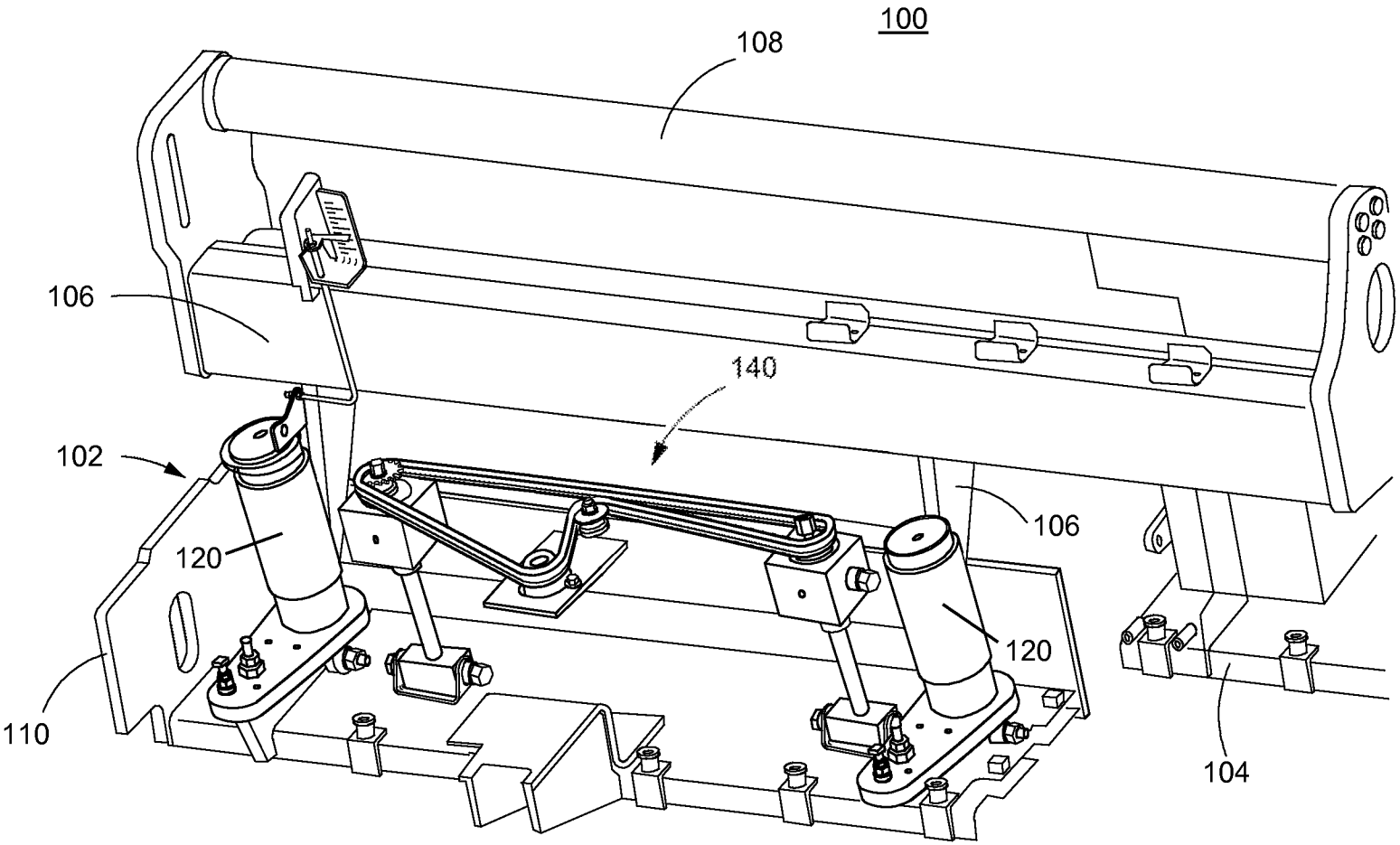
FIG. 1 is a perspective view of a screed assembly including an extendable screed mounted to a main screed.

FIG. 1 is a perspective view of a screed assembly 100 including an extendable screed 102 mounted to a main screed 104 of a paving machine. The extendable screed 102 may be attached to the main screed 104 via an upper extender frame 106 attached to one or more extend tubes 108. The extendable screed 102 may be hydraulically extended and retracted to provide the desired additional width. Because the extendable screed 102 is behind the main screed 104 it often needs to be separately adjusted relative to the main screed 104 so that the resulting asphalt mat is uniform. To accomplish this, a lower extender frame 110 of the extendable screed 102 may be adjusted for height and angle of attack relative to the main screed 104 using an adjustment apparatus 140, described in more detail with respect to FIG. 2.

The embodiment illustrated describes an extendable screed 102 that may be laterally adjusted via a hydraulic piston. It should be understood that the drawing of FIG. 1 shows only one side of the screed assembly 100 and that most embodiments will have a complementary arrangement on the opposite side of the main screed 104. In yet other embodiments, increasing the width of the screed assembly 100 may be accomplished by bolt-on extension screeds (not depicted). In an alternative embodiment, the bolt-on extension screeds may be coupled to the extendable screed 102. It is anticipated that the height and angle of attack adjustment of the lower extender frame 110 disclosed below applies equally whether the extendable screed includes a bolt-on extension or not.

A person of ordinary skill in the art will appreciate that the entire apparatus is more complex than the illustration shown and that for simplicity in developing this disclosure, many parts unrelated to the operation of the adjustment apparatus 140 are not shown.

Figure 2:
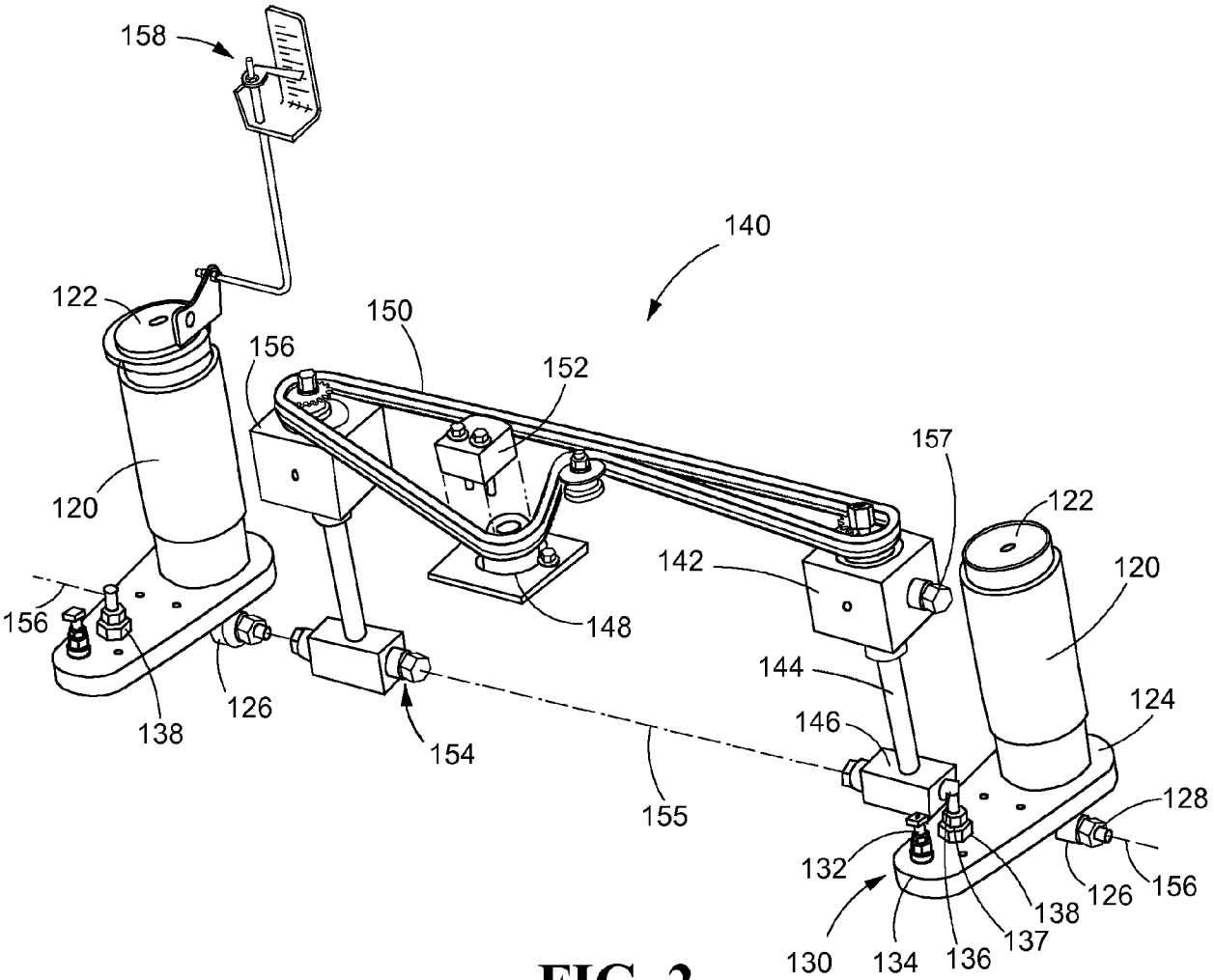
FIG. 2 is a perspective view of a height adjustment system for an extendable screed.

FIG. 2 illustrates an embodiment of an adjustment apparatus 140. The adjustment apparatus 140 includes elements directly attached to the upper extender frame 106 and elements attached to the lower extender frame 110. The upper extender frame 106 is not shown in FIG. 2.

One of the components attached to the upper extender frame 106 may be a height tube 120 welded or otherwise attached to the upper extender frame 106.

Also attached to the upper extender frame 106 is a vertical adjuster including one or more bearing housing trunnion mounts 142 with associated drive rods 144. As shown in the exemplary embodiment of FIG. 2, a belt or chain 150, may be driven by a drive mechanism 148 using a motor or crank (not depicted). A tensioner 152 may be used to absorb slack in a known manner. The bearing housing trunnion mount 142 may include a gear mechanism that turns the drive rods 144 depending on the direction of travel of the belt 150. In an embodiment, the drive rod 144 has a sprocket that engages the belt or chain 150. In an embodiment, the drive rods 144 are threaded. As will be discussed further below, the drive rods 144 may engage one or more threaded trunnion block-lifts 146 that are coupled to the lower extender frame 110, so that rotating or turning the drive rod 144 causes the trunnion block-lift 146 to raise and lower, and therefore causes the lower extender frame 110 to raise or lower relative to the main screed 104.

The elements of the adjustment apparatus 140 attached to the lower extender frame 110 include the trunnion block-lift 146. The trunnion block-lift 146 may be coupled to the lower extender frame 110 via a pin or bushing 154. By attaching the trunnion block-lift 146 using the pin or bushing 154, the lower extender frame 110 can rotate about the pin or bushing 154 in cooperation with the angle adjustment technique described below. Other components fixed to the lower extender frame 110 may also include a post 122 moveably inserted in the height tube 120 and a bracket 124 that is attached, for example, welded, to the post 122 below the height tube 120. In an embodiment, the height tube 120 and post 122 may be cylindrical in shape.

The bracket 124 may include an ear 126 with a bore used to attach the bracket 124 to the lower extender frame 110 using a pin 128. The pin 128 allows the lower extender frame 110 to rotate about the pin 128 relative to the bracket 124, as discussed more below with respect to FIG. 3.

The bracket 124 may be oblong or rectangular in shape so that an angle adjuster 130 may be disposed at a distance from the pin 128. The angle adjuster 130 may be a screw 132 or other elongate member that is, in an embodiment, fitted into a threaded hole 134 in the bracket 124 and coupled to the lower extender frame 110. In an embodiment, as illustrated, the screw 132 may push down on the lower extender frame 110, while a stud 136 may be fitted to the lower extender frame 110 and inserted through a hole in the bracket 124. To adjust the angle of attack, the screw 132 may be turned to press down on the lower extender frame 110 and a nut 137 on the stud 136 may be turned to pull up on the lower extender frame 110. Lock nuts or other fasteners or locks may be used to maintain the push/pull arrangement on the lower extender frame 110. In many applications, once the angle of attack of the lower extender frame 110 is adjusted relative to the main screed 104, it is rarely re-adjusted.

In other embodiments, the angle may be set by any other mechanism, such as a single screw with a ball-and-socket fitting (not depicted) on the lower extender frame 110, a hydraulically-driven pin, etc.

As shown in the illustrated embodiment, an axis of rotation 155 of the trunnion block-lift 146 about a longitudinal axis of pin or bushing 154 is collinear with an axis of rotation 156 of the bracket 124 about a longitudinal axis of pin 128. This allows the angle of attack of the lower extender frame 110 to be adjusted independently from the height setting. The bearing housing trunnion mount 142 may be mounted to the upper extender frame 106 with a pin or bushing 157 as a pivot point that allows at least a small amount of rotation between the adjustment apparatus 140 and the upper extender frame 106, such as may occur during operation of the screed assembly 100. A height indicator 158 attached to the post 122 may show a relative displacement between the extendable screed 102 and the main screed 104.

Figure 3:
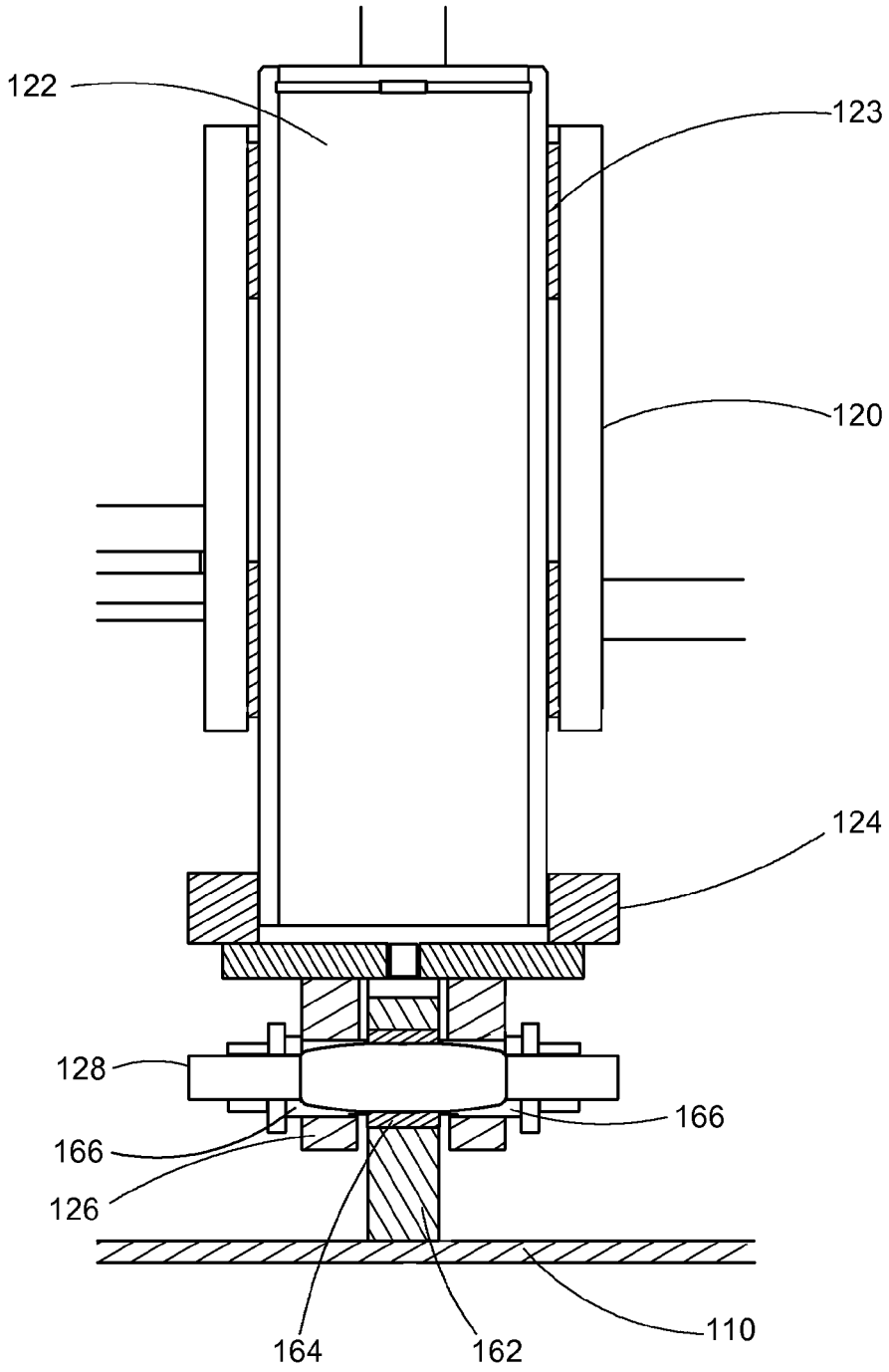
FIG. 3 is a cutaway view of a portion of the lower extender frame and height tube of FIG. 2.

FIG. 3 is a cutaway view of a portion of the lower extender frame 110 and height tube 120 of FIG. 2. As discussed above, the height tube 120 is fixed, e.g., welded, to the upper extender frame 106 while the post 122 and associated components connected below the post 122 are fixed to the lower extender frame 110. The illustration shows the post 122 inserted into the height tube 120. In the illustrated embodiment, one or more bushings 123 may be disposed between the height tube 120 and the post 122. The bushings 123 may reduce the play between the height tube 120 and post 122 as these components carry a considerable side load when the paver is in operation. FIG. 3 also shows the bracket 124 with ear 126. In an embodiment, the ear 126 may be welded to the bracket 124. The lower extender frame 110 may include a bulkhead plate 162 welded or otherwise formed or attached to the lower extender frame 110. The bulkhead plate 162 may have a dynamic bore with a bushing 164. By connecting the lower extender frame 110 to the bracket 124 using the pin 128, the lower extender frame 110 is able to rotate relative to the bracket 124. The bushing 164 may improve the ability to rotate the lower extender frame 110 about the pin 128. In an embodiment, the bushing 164 may be heat treated to reduce wear. A collet 166 may be disposed between the pin 128 and the bracket 124 to lock the pin to the ear 126 of the bracket 124.

INDUSTRIAL APPLICABILITY

Figure 4:
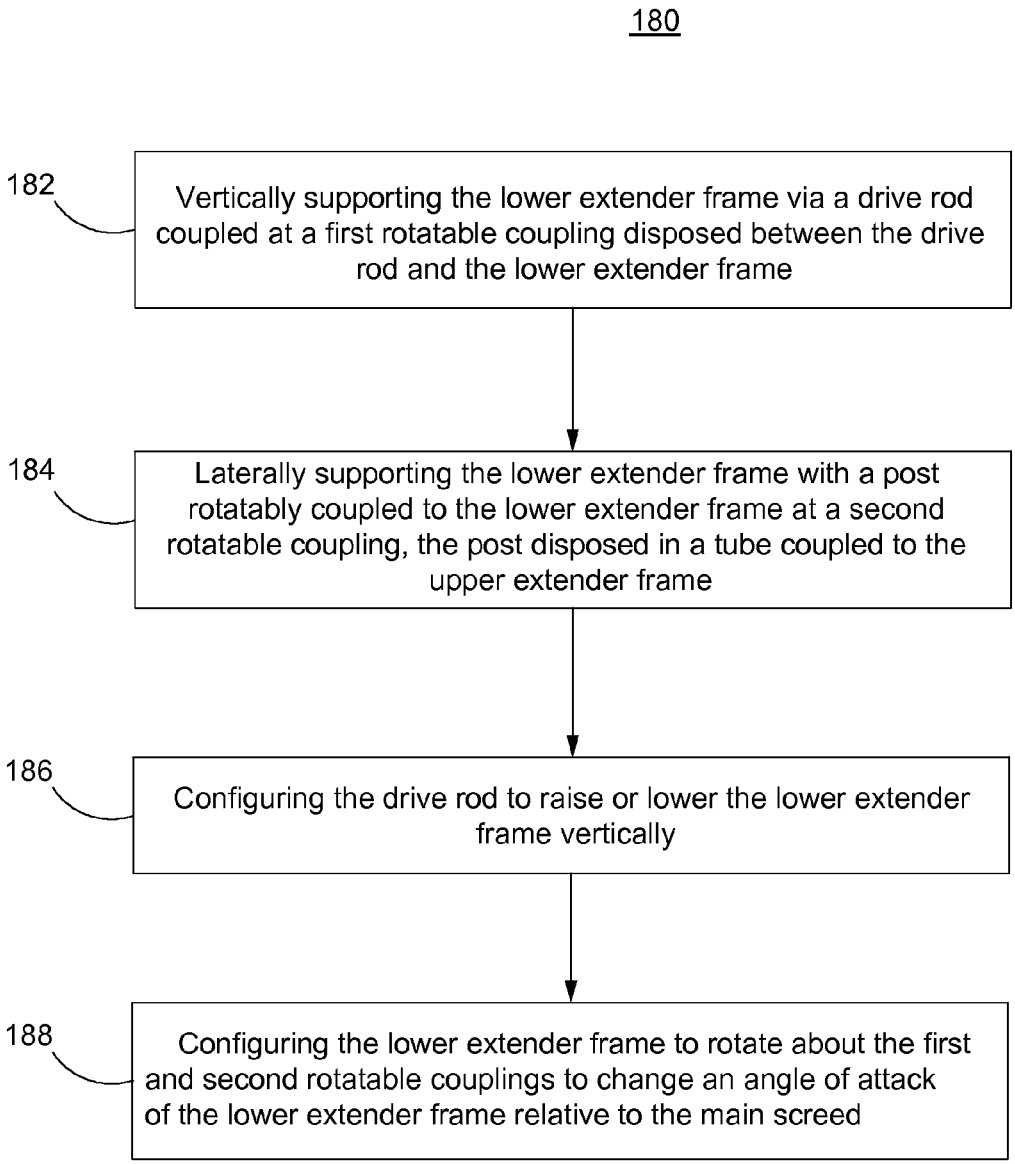
FIG. 4 is a flowchart of a method of adjusting the height and angle of attack of an extendable screed.

FIG. 4 is a flowchart of a method 180 of adjusting the height and angle of attack of an extendable screed 102. At a block 182, the lower extender frame 110 may be vertically supported with one or more drive rods 144. The drive rods 144 may be coupled at one end to the lower extender frame 110 at a trunnion block-lift 146. As discussed above, the trunnion block-lift 146 may be rotatably coupled to the lower extender frame 110. An opposite end of the drive rod 144 may be coupled to an upper extender frame 106 at a bearing housing trunnion mount 142. The bearing housing trunnion mount 142 and its associated framework (not fully depicted) may be attached to one or more extend tubes 108 of the main screed 104. In other embodiments, the upper extender frame 106 may be directly attached to the main screed 104.

At a block 184, lower extender frame 110 may be laterally supported with a post 122 rotatably coupled to the lower extender frame 110. The post 122 may be disposed in a height tube 120 that is coupled to the upper extender frame 106. In an embodiment a bushing 123 may be disposed between the post 122 and the height tube 120. In an embodiment, the rotatable coupling may use a pin 128 disposed between an ear 126 coupled to the post 122 and bulkhead plate 162 attached to the lower extender frame 110. Various embodiments may also include a bracket 124, as described above.

At a block 186, the one or more drive rods 144 may be configured to raise or lower the lower extender frame 110. For example, the drive rods 144 may be threaded so that when the drive rods turn they cause a threaded trunnion block-lift 146 to move on the drive rod 144. Because the trunnion block-lift 146 is attached to the lower extender frame 110, as the trunnion block-lift 146 moves on the drive rod 144, the lower extender frame 110 moves also.

At a block 188, the lower extender frame 110 may be configured to rotate about the first and second rotatable couplings to change an angle of attack of the lower extender frame 110 relative to the main screed 104. In an embodiment, the angle of attack may be adjusted by extending a screw 132 or other elongate member that is fixed to the bracket 124, that is itself attached to the post 122. The screw 132 may contact the lower extender frame 110 to provide a pressure that holds the lower extender frame 110 down. A stud 136 may be used to provide a counter pressure to urge the lower extender frame 110 up and lock it in place against the screw 132.

The height and angle adjustment apparatus and method described above provide a significant improvement over "four post" systems used on current extendable screeds because it eliminates the iterative adjustment of position at each post to achieve both the desired angle of attack and height. The current design, by placing an axis of rotation 155 of the height adjustment system 140 in line with an axis of rotation 156 of the angle of attack adjustment allows coordinated, but independent, control of both height and angle of attack. The post 122 and tube 120 arrangement provides the necessary support for the high lateral forces on the lower extender frame 110 during paving operations while allowing simple height adjustment. Similarly, the adjustment apparatus 140 provides an easy-to-operate mechanism for adjusting height of the lower extendable frame 110 relative to the main screed 104.

In accordance with the provisions of the patent statutes and jurisprudence, exemplary configurations described above are considered to represent a preferred embodiment of the present disclosure. However, it should be noted that the present disclosure can be practiced otherwise than as specifically illustrated and described without departing from its spirit or scope.

The invention claimed is:

1. An adjustment apparatus for adjusting an extendable screed relative to a main screed, the adjustment apparatus comprising:

an upper extender frame coupled to one or more extend tubes of the main screed;

a height tube coupled to the upper extender frame;

a post movably inserted in the height tube;

a first bracket attached to a lower portion of the post, the first bracket including a bore;

a lower extender frame having a bulkhead plate; and a pin disposed through the bore and the bulkhead plate that rotatably couples the first bracket to the lower extender frame about a longitudinal axis of the pin, such that rotation of the lower extender frame about the longitudinal axis of the pin results in a change in the angle of attack of the extendable screed.

2. The adjustment apparatus of claim 1, further comprising:

an elongate member coupled between the first bracket and the lower extender frame, the elongate member displaced from the longitudinal axis of the pin and configured to extend and retract to fix an angle of attack of the lower extender frame with respect to the upper extender frame.

3. The adjustment apparatus of claim 1, further comprising:

a vertical adjuster including:

a drive rod;

a bearing housing trunnion mount coupled to the upper extender frame and configured to turn the drive rod;

a trunnion block-lift rotably attached to the lower extender frame, the trunnion block-lift configured to be raised and lower by turning the drive rod.

4. The adjustment apparatus of claim 3, wherein an axis of rotation of the lower extender frame at the trunnion block-lift is collinear with the longitudinal axis of the pin.

5. The adjustment apparatus of claim 3, wherein the bearing housing trunnion mount further comprises a drive mechanism coupled to the bearing housing trunnion mount by one of a belt or a chain.

6. The adjustment apparatus of claim 5, wherein the drive mechanism is a motor.

7. The adjustment apparatus of claim 1, further comprising at least one bushing disposed between the height tube and the post.

8. The adjustment apparatus of claim 1, further comprising a collet disposed at the bore that stabilizes the pin.

9. The adjustment apparatus of claim 1, further comprising a bushing disposed in the bulkhead plate, wherein the bushing is heat treated.

10. A method of adjusting an extendable screed relative to a main screed, the extendable screed having an upper extender frame and a lower extender frame, the method comprising:

vertically supporting the lower extender frame via a drive rod coupled at a first rotatable coupling between the drive rod and the lower extender frame;

laterally supporting the lower extender frame with a post rotatably coupled to the lower extender frame at a second rotatable coupling, the post disposed in a tube coupled to the upper extender frame;

configuring the drive rod to raise or lower the lower extender frame; and configuring the lower extender frame to rotate about the first and second rotatable couplings to change an angle of attack of the lower extender frame relative to the main screed.

11. The method of claim 10, wherein laterally supporting the lower extender frame comprises disposing a bushing between the post and the tube.

12. The method of claim 10, wherein laterally supporting the lower extender frame with the post rotatably coupled to the lower extender frame comprises disposing a pin and collet between a bore coupled to the post and a bulkhead plate coupled to the lower extender frame.

13. The method of claim 10, further comprising:

coupling a bracket between the post and the second rotable coupling; and wherein configuring the lower extender frame to rotate about first and second rotatable couplings comprises providing an elongate member that is fixed to the bracket, the elongate member being in contact with the lower extender frame and configured to extend and retract.

14. An apparatus for adjusting a height and angle of attack of a lower extender frame of an extendable screed relative to a main screed in a paving machine; the apparatus comprising:

an upper extender frame coupled to one or more extend tubes of the main screed;

a height tube coupled to the upper extender frame;

a post movably inserted in the height tube;

a first bracket attached to a lower extent of the post, the first bracket including a bore;

the lower extender frame having a bulkhead plate proximate to the ear;

a pin disposed through the bore and the bulkhead plate that rotatably couples the first bracket to the lower extender frame about a longitudinal axis of the pin;

at least one elongate member coupled between the first bracket and the lower extender frame, the at least one elongate member displaced from the longitudinal axis of the pin, the at least one elongate member configured to extend and retract to set an angle of attack via rotation of the lower extender frame with respect to the upper extender frame about the longitudinal axis of the pin; and a vertical adjuster including:

a drive rod;

a bearing housing trunnion mount coupled to the upper extender frame and configured to turn the drive rod; and a trunnion block-lift attached to the drive rod and the lower extender frame, the trunnion block-lift configured to be raised and lowered relative to the bearing housing trunnion mount by turning the drive rod.

15. The apparatus of claim 14, further comprising a collet disposed between the pin and the bore, the collet configured to stabilize the pin relative to the bore.

16. The apparatus of claim 14, wherein the height tube is a hollow cylinder and the post is a cylinder.

17. The apparatus of claim 14, wherein the at least one elongate member is a screw that mounts in a threaded hole of the first bracket and impinges on the lower extender frame.

18. The apparatus of claim 14, wherein the at least one elongate member is a screw that mounts in a threaded hole of the first bracket and attaches to the lower extender frame at a ball-and-socket fitting.

19. The apparatus of claim 14, further comprising a motor that operates the vertical adjuster.

20. The apparatus of claim 14, further comprising a hand-operated crank that operates the vertical adjuster.

* * * * *